US006939106B2

(12) United States Patent
Murphy et al.

(10) Patent No.: US 6,939,106 B2
(45) Date of Patent: Sep. 6, 2005

(54) SEALING OF STEAM TURBINE NOZZLE HOOK LEAKAGES USING A BRAIDED ROPE SEAL

(75) Inventors: John Thomas Murphy, Niskayuna, NY (US); Steven Sebastian Burdgick, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 131 days.

(21) Appl. No.: 10/316,103

(22) Filed: Dec. 11, 2002

(65) Prior Publication Data

US 2004/0115046 A1 Jun. 17, 2004

(51) Int. Cl.[7] ..... F01D 9/00

(52) U.S. Cl. ..... 415/209.2; 415/209.3; 415/213.1

(58) Field of Search ..... 415/209.2–209.3, 415/213.1, 174.2, 170.1; 29/889.22

(56) References Cited

U.S. PATENT DOCUMENTS 3,394,919 A * 7/1968 Catterfeld ..... 415/138
4,022,545 A * 5/1977 Shank ..... 416/221
4,725,200 A * 2/1988 Welhoelter ..... 416/221
5,129,783 A * 7/1992 Hayton ..... 415/209.3
5,358,262 A * 10/1994 Roberts ..... 277/652
5,605,438 A 2/1997 Burdgick et al.
5,630,700 A * 5/1997 Olsen et al. ..... 415/134
6,039,325 A * 3/2000 Steinetz et al. ..... 277/633
6,126,389 A 10/2000 Burdgick
6,164,656 A * 12/2000 Frost ..... 277/312
6,190,120 B1 2/2001 Thatcher et al.
6,331,096 B1 12/2001 Burdgick et al.
6,343,911 B1 2/2002 Burdgick
6,375,415 B1 4/2002 Burdgick
6,375,429 B1 * 4/2002 Halila et al. ..... 416/193 A
6,386,825 B1 5/2002 Burdgick
6,390,769 B1 5/2002 Burdgick et al.
6,398,489 B1 6/2002 Burdgick et al.
6,402,466 B1 6/2002 Burdgick et al.
6,413,040 B1 7/2002 Yu et al.
6,418,618 B1 7/2002 Burdgick
6,419,445 B1 7/2002 Burdgick
6,422,810 B1 7/2002 Burdgick et al.
6,435,814 B1 8/2002 Yu et al.
6,446,979 B1 * 9/2002 Steinetz et al. ..... 277/630
6,453,557 B1 9/2002 Burdgick
6,464,453 B2 * 10/2002 Toborg et al. ..... 415/115
6,464,456 B2 * 10/2002 Darolia et al. ..... 415/134

* cited by examiner

*Primary Examiner*—Ninh H. Nguyen
(74) *Attorney, Agent, or Firm*—Nixon & Vanderhye P.C.

(57) ABSTRACT

A steam turbine includes a stator supporting a plurality of turbine nozzles. The stator has shaped grooves for receiving a complementary-shaped nozzle hook formed on an end of each of the turbine nozzles. A rope seal is disposed in each interface between the nozzle hooks and the shaped grooves, respectively. The rope seal serves to seal a leakage path that may exist over the nozzle hooks between the nozzles and respective stator grooves.

15 Claims, 2 Drawing Sheets

SEALING OF STEAM TURBINE NOZZLE HOOK LEAKAGES USING A BRAIDED ROPE SEAL

BACKGROUND OF THE INVENTION

The present invention relates to turbine nozzles of steam turbines and, more particularly, to sealing of steam turbine nozzle hook leakages using a braided rope seal.

Within a steam turbine, there are static nozzles (airfoils) that turn the flow into the buckets, which in turn extract work from the flow medium. In a reaction-style turbine design, these nozzles are assembled into an inner casing (shell). The nozzles are slid into a circumferential hook as individual or "ganged" nozzle segments. A leakage circuit exists around the nozzle to stator hook. This leakage bypasses the nozzle, and therefore the flow is not "turned" or accelerated through the nozzle throat. Both losses result in reduced stage efficiency and unaccounted for leakage to the system. Depending upon the machine intolerances, surface finish and nozzle loading, this leakage may be highly variable.

BRIEF DESCRIPTION OF THE INVENTION

In an exemplary embodiment of the invention, a steam turbine includes a stator supporting a plurality of turbine nozzles. The stator has shaped grooves for receiving a complementary-shaped nozzle hook formed on an end of each of the turbine nozzles. A rope seal is disposed in each interface between the nozzle hooks and the shaped grooves, respectively.

In another exemplary embodiment of the invention, a method of constructing a steam turbine is provided, where the steam turbine includes a plurality of nozzles with nozzle hooks and a stator with grooves shaped corresponding to the nozzle hooks. The method comprises the steps of inserting a rope seal in each of the stator grooves; and securing the nozzles in the stator grooves, respectively, via the nozzle hooks, whereby the rope seal is disposed in each interface between the nozzle hooks and the grooves.

In still another exemplary embodiment of the invention, a stator assembly for a steam turbine includes a plurality of shaped grooves for receiving a corresponding plurality of turbine nozzles via complementary-shaped nozzle hooks formed on an end of each of the turbine nozzles. The rope seal is disposed in each interface between the nozzle hooks and the shaped grooves, respectively.

DETAILED DESCRIPTION OF THE INVENTION

In steam turbine design, it is important to seal up as many leakage paths as possible within the turbine secondary (leakage) flow circuits. Each stage of a steam turbine consists of a rotor and bucket stage following a stage of nozzles (airfoils). In one turbine design, the stator nozzles (airfoils) are slid into circumferential hooks (grooves) in an inner or outer turbine casing (shell). Between these nozzles, where they enter the shell, is a slashface (end face) that is typically angled with respect to the engine axis, typically to accommodate the sweeping airfoil turning shape. A leakage path exists over the stator hooks between the nozzle and the turbine shell (stator structural unit). This leakage is caused by higher pressure steam in the forward cavity (upstream cavity). There is a pressure drop across the nozzle that causes this pressure differential. This leakage, if not accounted for, will cause increased efficiency losses. Such hooks typically exist in the high pressure (HP) and intermediate pressure (IP) steam turbine sections. This turbine design is typically based on impulse theory versus reaction theory, and the typical design has the airfoils welded into a diaphragm ring assembly.

Figure 1:
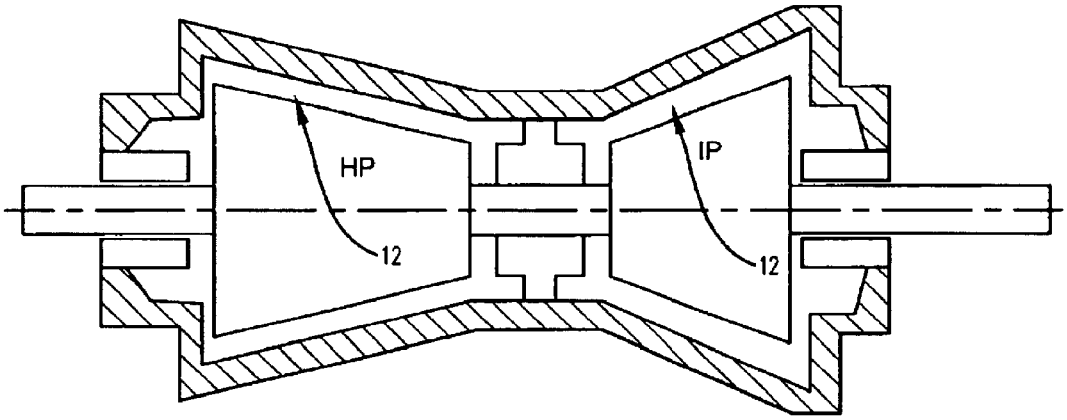
FIG. 1 is a side view of a typical HP/IP steam turbine.

FIG. 1 illustrates a side view of a typical HP/IP steam turbine. The nozzle areas are designated by reference numeral 12.

By the present invention, it has been discovered that a rope seal 10 such as a braided rope seal can be placed at an interface between the static nozzle segment aft (downstream) hook 14 and an axial load surface 16 of a groove 18 in the stator casing 20 for the purpose of reducing leakage flow across the interface. See FIG. 2. The seal 10 results in an efficiency increase of the stage, adding up to an increase in total machine performance. The seal 10 is preferably suited for reaction turbine designs.

Figure 2:
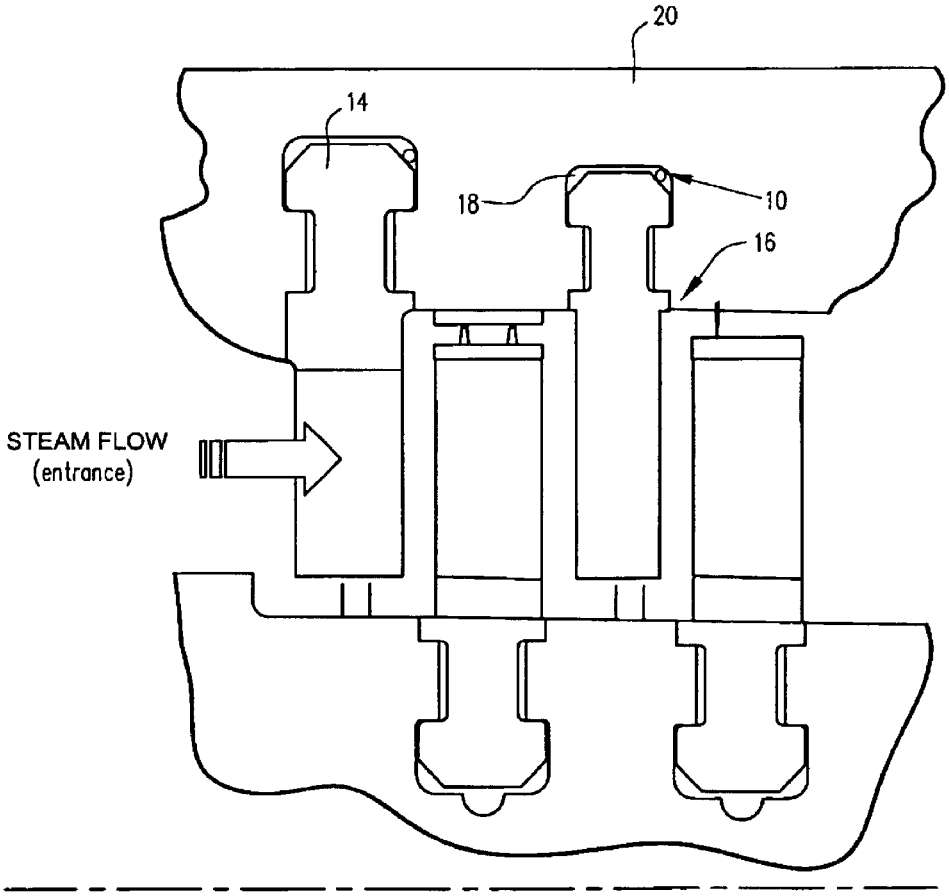
FIG. 2 is a schematic illustration of a nozzle shell cross section incorporating the rope seal of the present invention.

With continued reference to FIG. 2, the sealing design uses the circumferential braided rope seal 10 to seal the interface between the static nozzle segment aft (downstream) hook 14 and the axially loaded groove 16, 18 in the rotor. The seal 10 is typically used where the nozzles are individual or "ganged" segments that are slid into a circumferential hook in the stator casing.

Preferably, the braided rope seal 10 is formed of a braided metal sheathing surrounding a composite matrix such as ceramic. This gives the seal 10 flexibility and high temperature resistance while being able to retain some resiliency. The typical rope seal preferably has between $1/16^{th}$ –$3/16^{th}$ inch diameter.

In constructing the stator assembly, the rope seal 10 is inserted in the stator groove 18, and the nozzles 12 are secured in one-by-one around the stator circumference. The pressure differential across the nozzle stage would cause the rope seal 10 to deform into the gap between the nozzle hook 14 and the stator groove 18. As a result, the "over-the-hook" leakage is significantly reduced at this location. Preferably, the rope seal 10 is formed of a material such that once the seal has been put through at least one engine operating cycle, the seal should deform sufficiently into the gap and "permanently" stay in place. It has been shown through bench testing that this type of seal is much better at sealing leakages between components than existing metal-to-metal contact.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A steam turbine comprising a stator supporting a plurality of turbine nozzles, the stator including shaped grooves for receiving a complementary-shaped nozzle hook formed on an end of each of the turbine nozzles, wherein a rope seal is disposed in each interface between the nozzle hooks and the shaped grooves, respectively.

2. A steam turbine according to claim 1, wherein the rope seal comprises braided metal sheathing surrounding a composite matrix.

3. A steam turbine according to claim 2, wherein the composite matrix is ceramic.

4. A steam turbine according to claim 1, wherein the rope seal has a diameter between $1/16^{th}$ inch and $3/16^{th}$ inch.

5. A steam turbine according to claim 1, wherein the rope seal is formed of a material such that after the seal is put through at least one engine operating cycle, the seal will deform into the interface.

6. A steam turbine according to claim 1, wherein the rope seal is disposed in each interface between the nozzle hooks and an axially loaded surface of the shaped grooves, respectively.

7. A steam turbine according to claim 1, wherein the rope seal is a braided rope seal.

8. A method of constructing a steam turbine including a plurality of nozzles with nozzle hooks and a stator with grooves shaped corresponding to the nozzle hooks, the method comprising:

inserting a rope seal in each of the stator grooves; and securing the nozzles in the stator grooves, respectively, via the nozzle hooks, whereby the rope seal is disposed in each interface between the nozzle hooks and the grooves.

9. A stator assembly for a steam turbine including a plurality of shaped grooves for receiving a corresponding plurality of turbine nozzles via complementary-shaped nozzle hooks formed on an end of each of the turbine nozzles, wherein a rope seal is disposed in each interface between the nozzle hooks and the shaped grooves, respectively.

10. A stator assembly according to claim 9, wherein the rope seal comprises braided metal sheathing surrounding a composite matrix.

11. A stator assembly according to claim 10, wherein the composite matrix is ceramic.

12. A stator assembly according to claim 9, wherein the rope seal has a diameter between $1/16^{th}$ inch and $3/16^{th}$ inch.

13. A stator assembly according to claim 9, wherein the rope seal is formed of a material such that after the seal is put through at least one engine operating cycle, the seal will deform into the interface.

14. A stator assembly according to claim 9, wherein the rope seal is disposed in each interface between the nozzle hooks and an axially loaded surface of the shaped grooves, respectively.

15. A stator assembly according to claim 9, wherein the rope seal is a braided rope seal.

* * * * *